US011060323B2

(12) United States Patent
Almomani et al.

(10) Patent No.: US 11,060,323 B2
(45) Date of Patent: Jul. 13, 2021

(54) ELECTRONIC LOCK HAVING HARDWARE BASED MULTI-WIRELESS PROFILE DETECTION AND SETTING

(71) Applicant: Spectrum Brands, Inc., Middleton, WI (US)

(72) Inventors: Nedal Almomani, Mission Viejo, CA (US); Michael Maridakis, Garden Grove, CA (US)

(73) Assignee: Spectrum Brands, Inc., Middleton, WI (US)

( * ) Notice: Subject to any disclaimer, the term of this patent is extended or adjusted under 35 U.S.C. 154(b) by 243 days.

(21) Appl. No.: 14/059,625

(22) Filed: Oct. 22, 2013

(65) Prior Publication Data

US 2014/0113563 A1 Apr. 24, 2014

Related U.S. Application Data

(60) Provisional application No. 61/717,141, filed on Oct. 23, 2012.

(51) Int. Cl.
*E05B 47/00* (2006.01)
*G07C 9/00* (2020.01)

(52) U.S. Cl.
CPC ..... *E05B 47/00* (2013.01); *G07C 9/00817* (2013.01); *G07C 2009/00793* (2013.01); *G07C 2009/00833* (2013.01); *Y10T 70/625* (2015.04)

(58) Field of Classification Search
CPC .. H04W 88/06; H04W 76/02; H04M 2250/02
See application file for complete search history.

(56) References Cited

U.S. PATENT DOCUMENTS 5,739,766 A 4/1998 Chaloux
5,841,390 A * 11/1998 Tsui ..... G07C 9/00182 341/173
6,370,381 B1 4/2002 Minnick et al.
6,944,774 B2 * 9/2005 English ..... G06F 21/85 379/445
6,967,562 B2 * 11/2005 Menard ..... E05B 45/06 292/346

(Continued)

FOREIGN PATENT DOCUMENTS

CN 102436686 5/2012
CN 104103106 10/2014

(Continued)

OTHER PUBLICATIONS

USPTO; Office Action; dated Jun. 29, 2015; U.S. Appl. No. 14/059,652.

(Continued)

*Primary Examiner* — Lester G Kincaid
*Assistant Examiner* — Maryam Soltanzadeh
(74) *Attorney, Agent, or Firm* — Merchant & Gould P.C.

(57) ABSTRACT

An electronic lock with a wireless module configured to communicate wirelessly using a selected wireless communication protocol. The lock includes a hardware profile selector, such as a plurality of switches, which can be configured to set the wireless protocol used by the wireless module. For example, the hardware profile selector can be adjusted to change the wireless protocol used by the lock.

17 Claims, 6 Drawing Sheets

(56) References Cited

U.S. PATENT DOCUMENTS

| | | | | |
|---|---|---|---|---|
| RE39,144 | E * | 6/2006 | Pickard | E05B 47/0047 307/116 |
| 2003/0137404 | A1 | 7/2003 | Bonneau, Jr. et al. | |
| 2003/0160681 | A1 | 8/2003 | Menard et al. | |
| 2008/0011032 | A1 | 1/2008 | Groff | |
| 2008/0084310 | A1* | 4/2008 | Nikitin | G07F 19/208 340/572.7 |
| 2011/0234377 | A1 | 9/2011 | Landuyt | |
| 2011/0252843 | A1* | 10/2011 | Sumcad | G07C 9/00896 70/91 |
| 2012/0196588 | A1* | 8/2012 | Shah | H04W 8/22 455/419 |
| 2013/0295986 | A1 | 11/2013 | Mueck | |

FOREIGN PATENT DOCUMENTS

| | | | |
|---|---|---|---|
| EP | 0753822 | A2 | 1/1997 |
| EP | 1835436 | A2 | 9/2007 |
| WO | WO2009/158181 | | 12/2009 |

OTHER PUBLICATIONS

International Search Report; Patent CooperationTreaty; dated Feb. 6, 2014.

* cited by examiner

ELECTRONIC LOCK HAVING HARDWARE BASED MULTI-WIRELESS PROFILE DETECTION AND SETTING

RELATED APPLICATIONS

The present application is related to and claims priority to U.S. Provisional Patent Application Ser. No. 61/717,141 filed on Oct. 23, 2012, entitled Electronic Lock having Hardware Based Multi-Wireless Profile Detection and Setting. The subject matter disclosed in that provisional application is hereby expressly incorporated by reference into the present application in its entirety.

TECHNICAL FIELD

The present invention relates to electronic locks, and, more particularly, to an electronic lock having hardware based multi-wireless profile detection and setting.

BACKGROUND AND SUMMARY

Electronic locks are commercially available having a capability of communicating via using a standardized short range wireless radio frequency (r.f.) communication protocol, such as for example, the Zigbee and Z-Wave wireless communications protocols. Lock and systems developers often customize their respective commercial offerings to include customer specific communication hardware and methods that utilize variations of standard protocols. As such, each electronic lock hardware unit has to be customized to support a particular customer's system communications configuration of a plurality of potential customer configurations. Thus, a manufacturer of electronic locks must have on-hand separate electronic lock hardware units, i.e., stock keeping units (SKUs), which satisfy the communications requirements of each of its customers, thus adding cost and complexity in the entire supply chain in addition to potentially adding confusion in the distribution channel for the distributors and dealers who deal with these variations.

What is needed in the art is an electronic lock having hardware based multi-wireless profile detection and setting, wherein a single electronic lock is configurable to enable an installer or user to set a desired wireless communication protocol profile, or configuration, to allow the electronic lock to communicatively join the system in which the electronic lock is to be incorporated.

According to one aspect, the present invention provides an electronic lock. The lock may include a latch assembly including a bolt movable between an extended position and a retracted position and a circuit configured to control movement of the bolt. The circuit includes a processing unit, a memory unit, a wireless module and a hardware profile selector. A plurality of wireless profiles are stored in the memory which correspond to wireless communications protocols. The wireless module is configured to communicate wirelessly using a selected wireless communication protocol, which is set by the hardware profile selector. In some embodiments, at least a portion of the wireless profiles stored in the memory unit correspond with multiple profiles of the Zigbee wireless protocol and/or multiple profiles of the Z-wave wireless protocol. In some cases, the plurality of wireless profiles include profiles codes corresponding to respective wireless protocols.

Depending on the circumstances, the processing unit could be a microprocessor with a plurality of input pins electronically connected with the hardware profile selector.

For example, the hardware profile selector could include a plurality of switches configurable to set the selected wireless protocol. In some cases, the plurality of switches may be user-actuatable switches, such as dip switches, momentary switches and/or slide switches.

According to another aspect, the invention provides a method of selecting a wireless protocol for an electronic lock. For example, an electronic lock could be provided with a wireless module that facilitates wireless communications. The electronic lock may include a hardware profile selector configured to set a selected wireless protocol used by the wireless module between a first wireless protocol and a second wireless protocol. The hardware profile selector is adjusted to change the selected wireless protocol used by the wireless module between the first wireless protocol and the second wireless protocol. In some cases, the adjusting step changes the wireless protocol between the Zigbee wireless protocol and Z-wave wireless protocol. Embodiments are contemplated in which the hardware profile selector includes a plurality of switches configurable to set the selected wireless protocol. For example, the adjusting step includes changing a position of one or more of the plurality of switches.

According to a further aspect, the invention provides an electronic lock with a wireless module configured to communicate wirelessly using a selected wireless communication protocol. The electronic lock includes a non-transitory computer-readable medium having wireless profile data including a plurality of wireless profile codes and a computer program code stored thereon. A hardware profile selector is provided that is configured to set the selected wireless communication protocol. The lock includes a processor in communication with the computer-readable memory configured to carry out instructions in accordance with the computer program code. When the computer program code is executed by the processor, the processor detects the switch conditions of the hardware profile selector. This allows the processor to identify a selected wireless profile code stored in the computer-readable medium corresponding to the switch conditions of the hardware profile selector. Upon identification of the selected protocol, the wireless module is configured to communicate using a wireless protocol corresponding to the selected wireless profile code.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

Corresponding reference characters indicate corresponding parts throughout the several views. The exemplifications set out herein illustrate an embodiment of the invention, and such exemplifications are not to be construed as limiting the scope of the invention in any manner.

DETAILED DESCRIPTION OF THE DRAWINGS

Figure 1A:
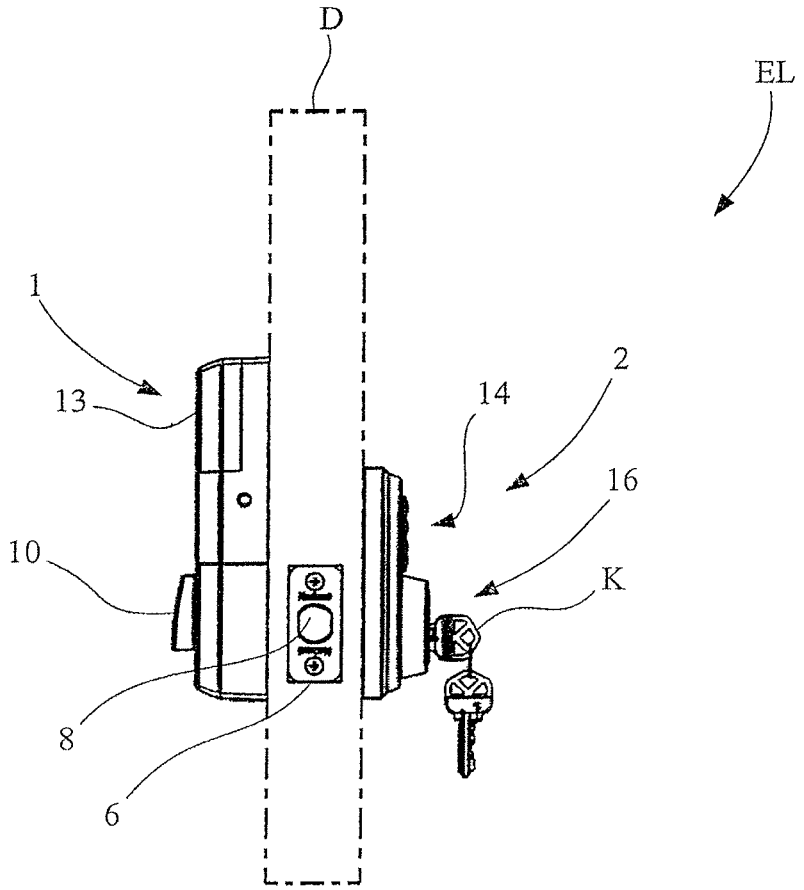
FIG. 1A is a side view of an electronic lock in accordance with an embodiment of the present invention, installed on a door and with the door show in phantom lines.
Figure 1B:
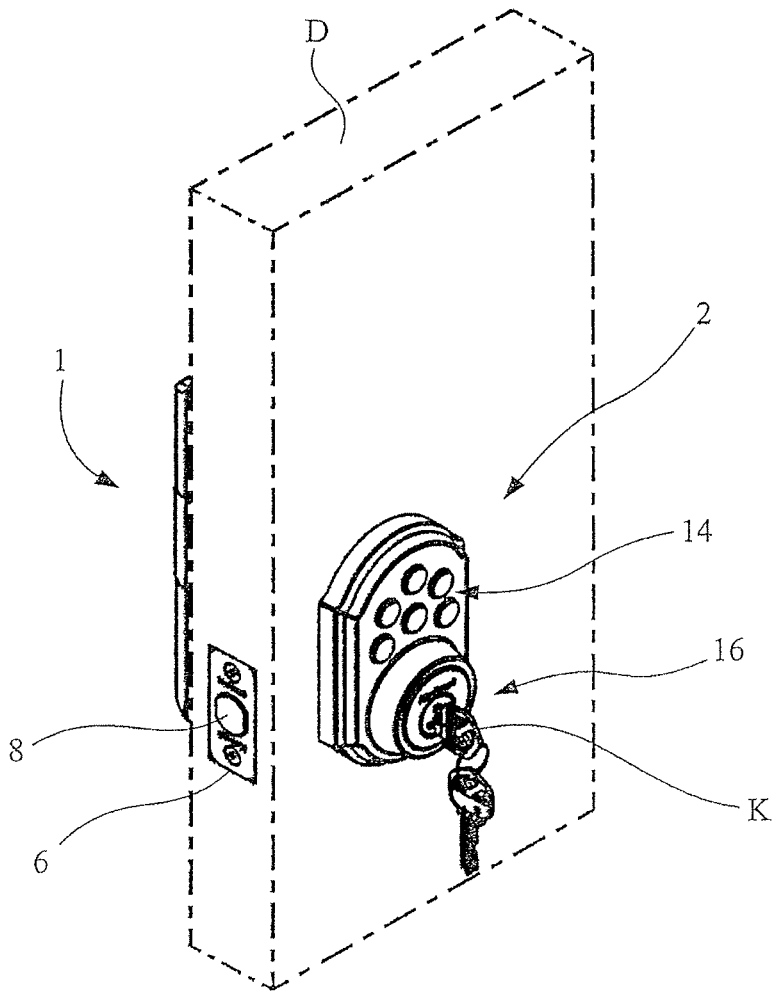
FIG. 1B is a perspective view of the electronic lock of FIG. 1A, as viewed from the exterior of the door.
Figure 1C:
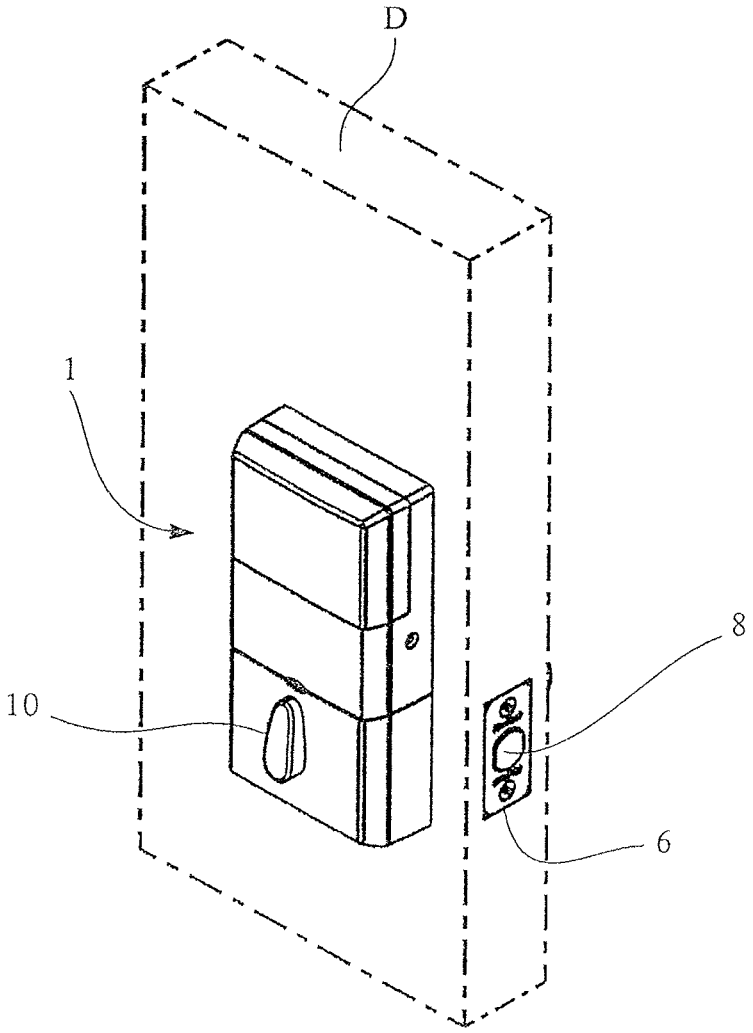
FIG. 1C is a perspective view of the electronic lock of FIG. 1A as viewed from the interior of the door.

Referring now to the drawings and particularly to FIGS. 1A-1C and 2, there is shown an electronic lock (EL) in accordance with an embodiment of the present invention for mounting on a door D, and which includes an interior chassis 1, an exterior chassis 2, a mounting plate 3, an adapter 4, a latch assembly 5, and a strike 6.

Figure 2:
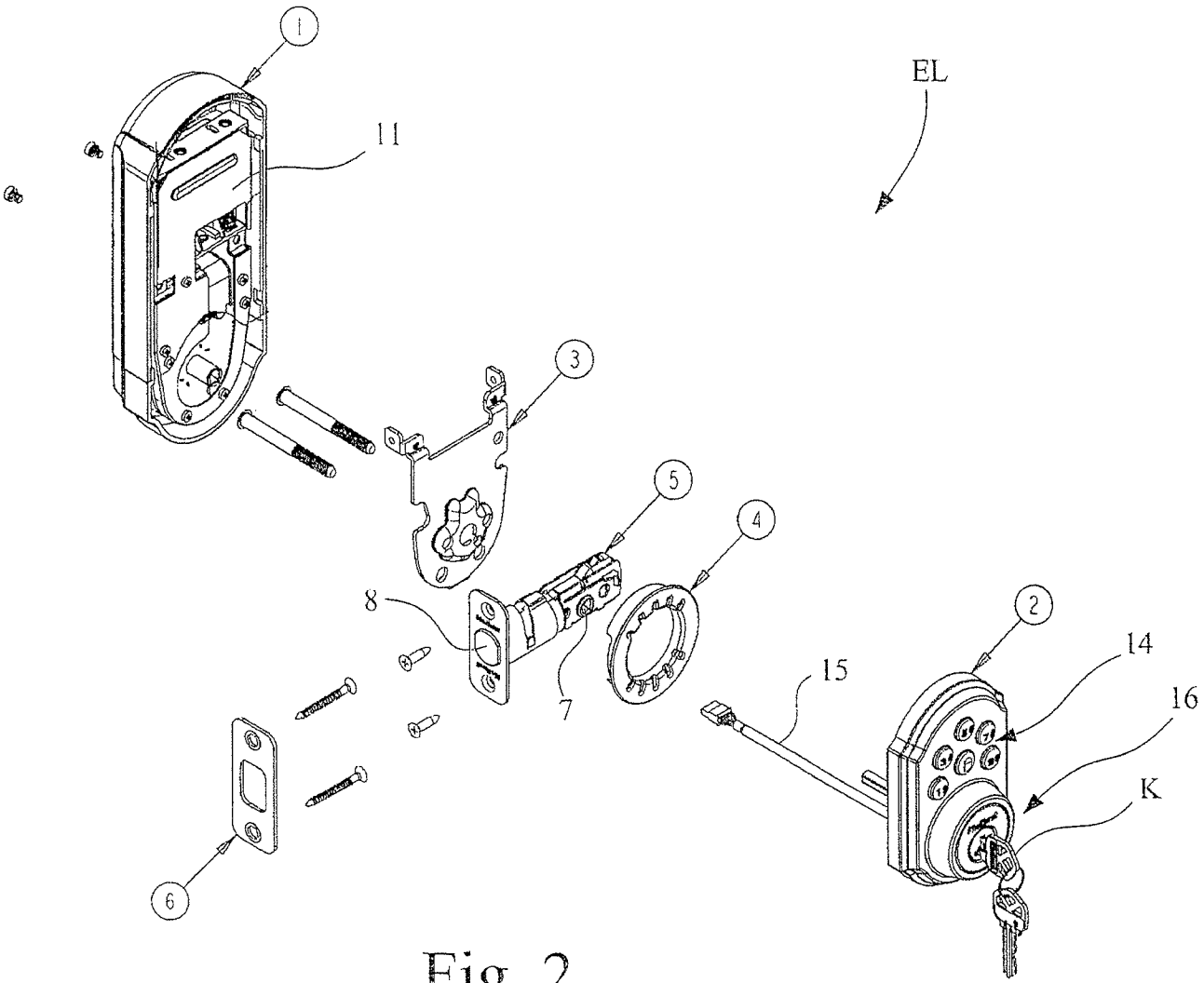
FIG. 2 is an exploded view of the electronic lock of FIGS. 1A-1C.

As shown in FIG. 2, latch assembly 5 is of a configuration well known in the art, and includes a bolt actuator mechanism 7, and a bolt 8. Mounting plate 3 is used to mount the electronic lock to the door D. Adapter 4 is used to adapt the electronic lock to a particular hole opening in the door D.

Figure 3:
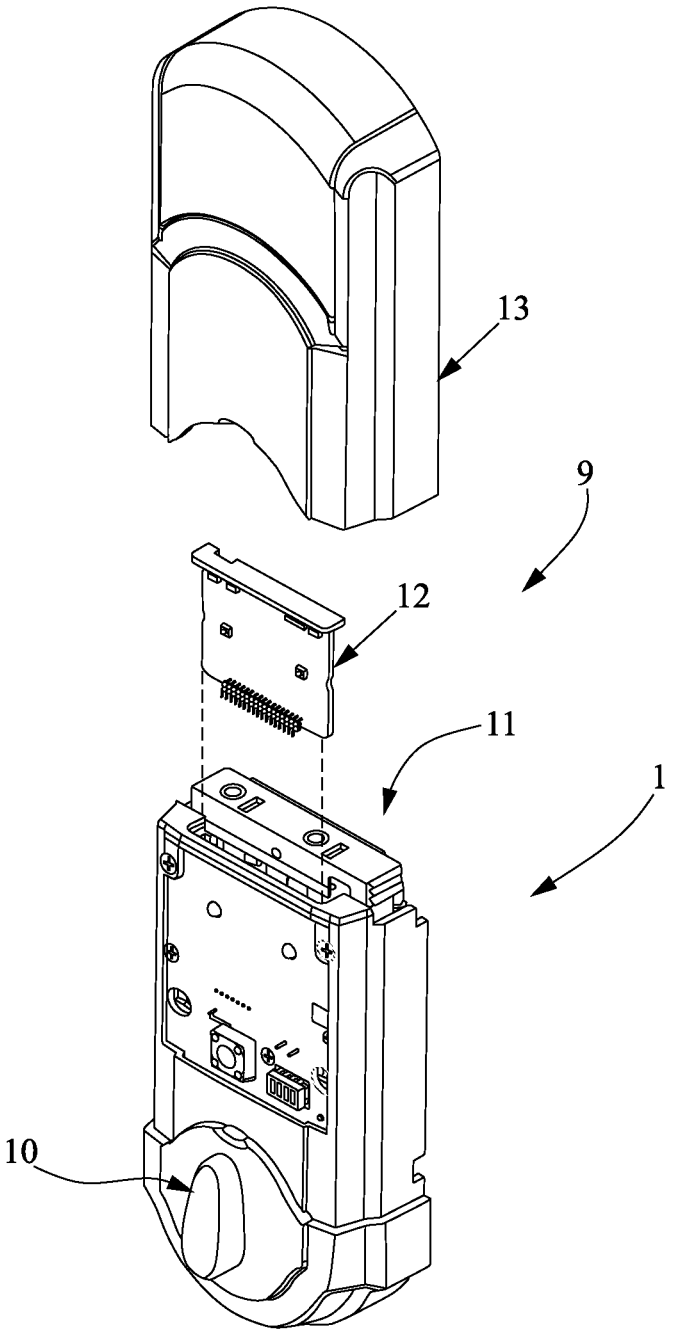
FIG. 3 is a perspective view of the interior chassis of the electronic lock of FIG. 2, with the upper cover and daughter card removed.

Referring also to FIG. 3, interior chassis 1 includes the electronics circuitry 9 for the electronic lock, and further includes a manual turnpiece 10. Manual turnpiece 10 is used on the interior side of door D to operate the bolt actuator mechanism 7 of latch assembly 5, and in turn to extend and retract bolt 8 (see also FIG. 1C). The electronics circuitry 9 includes a base board 11 and a removable daughter card 12. In FIG. 3, a removable cover 13 is provided to cover over the base board 11 and daughter card 12, when cover 13 is in the installed position. Daughter card 12 is a wireless communications module that facilitates wireless communications with an external device though a desired wireless communications protocol, e.g., Zigbee, Z-wave, etc.

Referring again to FIG. 2, exterior chassis 2 includes a keypad 14 for receiving a user input. Keypad 14 is electrically connected to the base board 11 of electronics circuitry 9, such as for example by an electrical cable 15. When the user inputs a valid code via keypad 14 that is recognized by the electronics circuitry 9, an electrical motor (not show) is energized to retract the bolt 8 of latch assembly 5, thus permitting door D (see FIG. 1B) to be opened from a closed position. Alternatively, a key actuator 16, having a removable key K, is provided for manually operating latch assembly 5 from the exterior of the door D.

Figure 4:
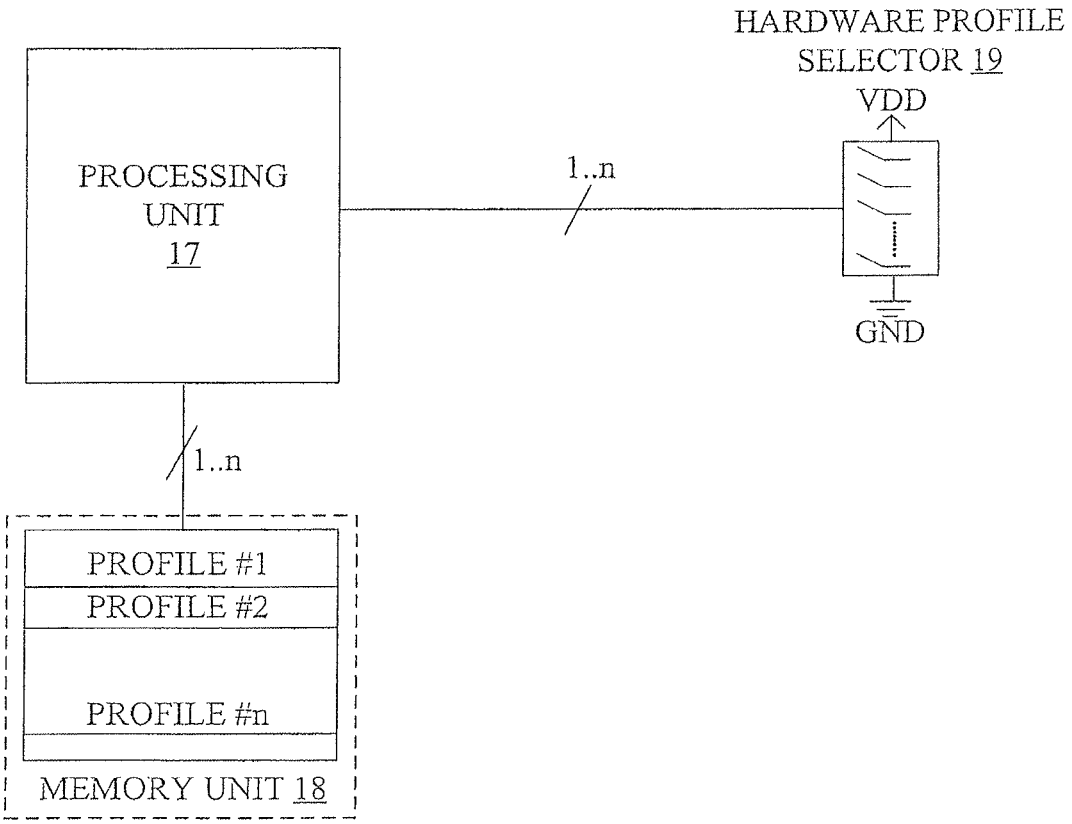
FIG. 4 is a block diagram of a portion of the control electronics of the interior chassis of FIG. 3, according to an embodiment of the invention.

Referring particularly to FIG. 3 and FIG. 4, daughter card 12 is a wireless communications module that facilitates wireless communications with an external device through a desired wireless communications protocol, e.g., Zigbee, Z-wave, etc. In accordance with an embodiment of the present invention, base board 11 and/or daughter card 12 of electronics circuitry 9 is configurable to enable an installer or user to set a desired wireless protocol Profile, i.e., configuration, corresponding to a standard wireless protocol or a desired variation of the standard wireless protocol, so as to allow the electronic lock to communicatively join a system into which the electronic lock is being inserted. For example, multiple profiles could be provided for the Zigbee protocol based on different manufacturer implementations. Likewise, as an example, multiple profiles could be provided for the Z-wave protocol based on different manufacturer implementations.

Electronics circuitry 9 may include, for example, an EMBER Corporation EM357 chip along with associated devices to handle all IEEE 802.15.4 operations. The chip and associated devices is driven by a 24.00 MHz crystal which is used to produce other internal clocks. Additional devices, such as LED's, switches, other integrated circuits, antenna and others are designed into electronics circuitry 9.

Referring to FIG. 4, electronics circuitry 9 includes a processing unit 17, a memory unit 18, and a hardware profile selector 19. Processing unit 17 includes a commercially available microprocessor or a custom built processing unit (ASIC=Application Specific Integrated Circuit) and associated input/output (I/O) circuitry, and is configured for electronic communication with memory unit 18 and hardware profile selector 19. A number of GPIO (General Input-Output) pins are connected to the microprocessor. The state of these GPIO pins can be set by the user (digital High "1" or Low "0") via a set of switches of the hardware profile selector 19. Processing unit 17 is configured such that during a system boot-up process (e.g., at power up) or a designated profile selection event, processing unit 17 reads the configuration of these GPIO pins.

Memory unit 18 is an electronic semiconductor memory device, such as for example, a read only memory (ROM), erasable programmable read only memory (EPROM), electrically erasable programmable read only memory (EEPROM), embedded memory in the processing unit 17 etc. As shown in FIG. 4, memory unit 18 is configured to store a plurality of wireless protocol Profiles #1-#n associated with the desired wireless communication protocol. Each wireless protocol Profile stored in memory unit 18 corresponds to a standard wireless protocol and/or a specific variation of the standard wireless protocol as dictated by the wireless communications system requirements of a respective customer. Alternatively, or in addition, it is contemplated that memory unit 18 may store a plurality of sets of wireless protocol Profiles, with each set of wireless protocol Profiles being associated with a respective wireless communication protocol.

Hardware profile selector 19 is a set of switches that is used to generate a multi-digit binary number, wherein for example, a switch open condition represents a binary "0" Low and a switch closed condition represents a binary "1" High. The number of switches used and/or physically present in hardware profile selector 19 will determine the number of wireless protocol Profiles that are selectable in memory unit 18. For example, three switches may be used for the binary range of 000 through 111, thus providing eight possible combinations that may be used to access eight different wireless protocol Profiles. In some embodiments, other computer number systems could be used to encode the profile location or position while the current invention shows a binary coded profile position. In some cases, the hardware profile selector 19 could be configured for negative logic so a "0" corresponds with an "on" or "high" condition.

Hardware profile selector 19 may be a set of DIP switches, or alternatively a combination of DIP switches and one or more momentary switches. Such momentary switches may be a designated dual purpose switch, such as one or more of the buttons of the keypad 14, or other momentary switch(es) on base board 11. The one or more momentary switches, for example, would be used in wireless protocol profile selection at power up only or at a designated profile selection event, such as at an installer's specific request for profile selection, when a physical interaction with the user/installer is required for switch condition setting selection in hardware profile selector 19. However, non-momentary switches, such as DIP switches, once set do not require physical interaction with the user/installer during wireless protocol profile selection. In some embodiments, for example, a slide switch sold under model number CUS-12TB by Copal Electronics could be used in combination with one or more momentary switches and/or DIP switches of hardware profile selector 19.

In accordance with an embodiment, on boot-up or a designated profile selection event, processing unit 17 executes program instructions to run a profile selection scheme in which processing unit 17 of electronics circuitry 9 reads the switch positions of hardware profile selector 19, and automatically retrieves from memory unit 18 a desired wireless communication protocol Profile from the plurality of wireless protocol Profiles stored in memory unit 18. For example, a Profile code 101 of hardware profile selector 19 may be correlated to wireless protocol Profile #1 in memory unit 18, a Profile code 110 of hardware profile selector 19 may be correlated to wireless protocol Profile #2 in memory unit 18, etc. Processing unit 17 then executes the selected wireless protocol Profile in configuring electronics circuitry 9 for the communication system in which the electronic lock is being installed.

If no change is detected (e.g., since last boot-up), processing unit 17 will execute a Default or Loaded Profile.

If a change is detected (since last boot-up), then the wireless protocol Profile corresponding to the configuration defined by the switch settings will be loaded in the program execution memory of processing unit 17. Program execution memory may be processor memory on the microprocessor module, or alternatively may be a portion of memory unit 18.

From this time on, the electronics circuitry 9 will execute the same profile.

To switch to a different Profile of the wireless protocol Profiles stored in memory unit 18, the following sequence is executed:

a. power down electronics circuitry 9 (or use of digital switch to perform soft reset);
b. reconfigure state of GPIO pins through a selection of the switch conditions in the hardware profile selector 19;
c. power electronics circuitry 9 back up;
d. processing unit 17 loads the new wireless protocol Profile into processor memory from memory unit 18 based on the switch conditions set in the hardware profile selector 19 and the new wireless protocol Profile is executed from that time on.

While the GPIOs are typically used or read by the microprocessor of processing unit 17, it is contemplated that any pins or input could be used that can be read at power-up or before the Profile code is required to load.

Advantageously, the present invention allows the flexibility to add new profiles on the same electronic lock (EL) unit, i.e., stock keeping unit (SKU), to accommodate the various wireless protocol Profile configuration requirements of multiple customers, without having to create new hardware specific to a particular customer, e.g., system provider. Also, the present invention provides flexibility during manufacturing of the electronic lock (EL) SKU if and when a new custom wireless protocol Profile is required by a customer.

While this invention has been described with respect to an embodiment of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. An electronic lock comprising:

a latch assembly including a bolt movable between an extended position and a retracted position;

an interior assembly including a base and a cover positioned over the base;

an exterior assembly; and a circuit positioned at the interior assembly configured to control movement of the bolt between the extended and retracted positions, wherein the circuit includes a processing unit, a memory unit storing a plurality of wireless profiles, each wireless profile corresponding to a different predetermined short range wireless communications protocol, a wireless module configured to communicate wirelessly using a selected wireless communication protocol, and a hardware profile selector configured to set the selected wireless communication protocol from the plurality of predetermined wireless profiles stored in the memory unit based on a changeable position of one or more of a plurality of switches of the hardware profile selector, each of the plurality of stored profiles corresponding to a discrete position of the plurality of switches, the plurality of switches being coverable by the cover of the interior assembly, wherein the plurality of switches includes one or more user-actuatable switches, wherein the user-actuatable switches are separate from the latch assembly;

wherein the processing unit is further configured to read the position of the plurality of switches of the hardware profile selector at a system boot-up process, and the processing unit is programmed to set the selected protocol of the wireless module responsive to a changing of position of one or more of the user-actuatable switches of the hardware profile selector, wherein, once set by the processing unit, the processing unit is further configured to maintain the wireless module in operation only in the selected wireless protocol that is associated with the position of the one or more user-actuatable switches until the position of the one or more user-actuatable switches is changed and the electronic lock is reset.

2. The electronic lock as recited in claim 1, wherein at least a portion of the wireless profiles stored in the memory unit correspond with multiple profiles corresponding with the Zigbee wireless protocol or multiple profiles corresponding with the Z-wave wireless protocol.

3. The electronic lock as recited in claim 1, wherein the plurality of wireless profiles include profile codes corresponding to a respective wireless protocol.

4. The electronic lock as recited in claim 1, wherein the processing unit is a microprocessor with a plurality of input pins electronically connected with the hardware profile selector.

5. The electronic lock as recited in claim 1, wherein the plurality of switches includes one or more dip switches.

6. The electronic lock as recited in claim 1, wherein the plurality of switches includes one or more momentary switches.

7. The electronic lock as recited in claim 1, wherein the plurality of switches includes one or more slide switches.

8. The electronic lock as recited in claim 1, wherein the plurality of switches includes a digital switch set by another processing unit.

9. A method of selecting a wireless protocol for an electronic lock, the method comprising the steps of:

providing an electronic lock having a latch assembly including a bolt movable between an extended position and a retracted position, the electronic lock having an interior assembly and an exterior assembly, the interior assembly including a base and cover positioned over the base, the interior assembly including a wireless module configured to facilitate short range wireless communications, the interior assembly including a memory unit storing at least two wireless profiles, each wireless profile corresponding to a different predetermined short range wireless communications protocol, wherein the electronic lock includes a hardware profile selector configured to set a selected short range wireless protocol used by the wireless module between a predetermined first short range wireless protocol and a predetermined second short range wireless protocol stored in the memory unit based on a position of one or more of a plurality of switches of the hardware profile selector, the plurality of switches being coverable by the cover of the interior assembly, wherein the plurality of switches includes one or more user-actuatable switches, wherein the user-actuatable switches are separate from the latch assembly;

adjusting the hardware profile selector to change the selected wireless protocol used by the wireless module between the first short range wireless protocol and the second short range wireless protocol;

wherein the adjusting step includes changing a position of one or more of the plurality of switches of the hardware profile selector, and wherein, the wireless module is maintained in operation only in the selected wireless protocol that is associated with the position of the one or more user-actuatable switches until the position of the one or more user-actuatable switches is changed and the electronic lock is reset; and reading the position of the plurality of switches of the hardware profile selector at a system boot-up process.

10. The method as recited in claim 9, wherein the adjusting step changes the wireless protocol between multiple profiles of the Zigbee wireless protocol or multiple profiles of the Z-wave wireless protocol.

11. The method as recited in claim 9, wherein the plurality of switches includes one or more of dip switches, momentary switches, or slide switches.

12. An electronic lock comprising:

a latch assembly including a bolt movable between an extended position and a retracted position;

an interior assembly including a base and a cover positioned over the base;

an exterior assembly;

a circuit configured to control movement of the bolt between the extended and retracted positions;

a wireless module configured to communicate wirelessly at short range using a selected short range wireless communication protocol;

a non-transitory computer-readable medium having wireless profile data including a plurality of wireless profile codes and a computer program code stored thereon, each of the wireless profile codes corresponding to a different predetermined short range wireless communications protocol;

a hardware profile selector configured to set the selected short range wireless communication protocol from the different predetermined short range wireless communication protocols corresponding to the plurality of wireless profile codes on the non-transitory computer-readable medium based on a position of one or more of a plurality of switches of the hardware profile selector, the plurality of switches being coverable by the cover on the interior assembly, wherein the plurality of switches are separate from the latch assembly;

a processor in communication with the computer-readable medium configured to carry out instructions in accordance with the computer program code, wherein the computer program code, when executed by the processor, causes the processor to perform operations comprising:

detecting the switch conditions of the hardware profile selector at a system boot-up process;

identifying a selected short range wireless profile code stored in the computer-readable medium corresponding to the switch conditions of the hardware profile selector; and responsive to identification of the selected wireless profile code, configuring the wireless module to communicate using the predetermined short range wireless protocol corresponding to the selected wireless profile code, wherein, once set, the wireless module communicates only in the selected wireless protocol that is associated with the position of the one or more of the plurality of switches until the position of the one or more of the plurality of switches is changed and the electronic lock is reset.

13. The electronic lock of claim 12, wherein the wireless profile data includes a first wireless profile code corresponding to a first implementation of the Zigbee wireless protocol and a second wireless profile code corresponding to a second implementation of the Zigbee wireless protocol.

14. The electronic lock of claim 13, wherein the hardware profile selector is configured to switch the wireless module between multiple profiles of the Zigbee wireless protocol or multiple profiles of the Z-wave wireless protocol.

15. The electronic lock of claim 14, wherein the hardware profile selector is one or more of dip switches, momentary switches, or slide switches.

16. The electronic lock of claim 1, further comprising a key actuator being configured for manually operating the latch assembly, wherein the user-actuatable switches are separately actuatable from the key actuator.

17. The electronic lock of claim 12, further comprising a key actuator being configured for manually operating the latch assembly, wherein the position of one or more of a plurality of switches of the hardware profile selector is separately changeable from movement of the key actuator.

* * * * *